United States Patent [19]

Braun

[11] 4,217,771

[45] Aug. 19, 1980

[54] METHOD OF COLD FORMING

[75] Inventor: Frederick W. Braun, Bloomfield Hills, Mich.

[73] Assignee: Braun Engineering Company, Detroit, Mich.

[21] Appl. No.: 9,264

[22] Filed: Feb. 2, 1979

Related U.S. Application Data

[62] Division of Ser. No. 864,544, Dec. 27, 1977, Pat. No. 4,166,373.

[51] Int. Cl.[2] ..... B21D 22/00

[52] U.S. Cl. ..... 72/358; 72/370

[58] Field of Search ..... 72/353, 354, 356, 357, 72/358, 359, 367, 370, 377; 10/27 E, 86 F, 86 R

[56] References Cited

U.S. PATENT DOCUMENTS

| | | | |
|---|---|---|---|
| 1,595,588 | 8/1926 | Tuttle | 72/354 |
| 2,748,464 | 6/1956 | Kaul | 72/356 |
| 2,774,259 | 12/1956 | Caulkins | 72/377 |
| 2,904,173 | 9/1959 | Braun | 10/27 E |
| 3,842,646 | 10/1974 | Kuhn | 72/354 |
| 4,061,013 | 12/1977 | Kue | 72/356 |
| 4,078,415 | 3/1978 | Koch | 72/377 |

FOREIGN PATENT DOCUMENTS

| | | | |
|---|---|---|---|
| 617905 | 2/1949 | United Kingdom | 10/27 E |

*Primary Examiner*—Francis S. Husar
*Assistant Examiner*—Gene P. Crosby
*Attorney, Agent, or Firm*—Whittemore, Hulbert & Belknap

[57] ABSTRACT

The invention relates to the cold extrusion of a part having a polygonal interior and a cylindrical exterior. Instead of the usual process of forcing a polygonal punch into a billet in a single extrusion step, the new method employs a plurality of extrusion steps, first forming a lobed preparatory blank and then in a second extrusion step providing a punch and die combination whereby the external lobes of the intermediate part are forced radially inwardly. In the second extrusion step a polygonal punch is used to provide the proper polygonal interior surface. A cooperating die is provided with an upper lobed cavity for receiving the lobed preparatory blank and this die is oriented with respect to the polygonal punch so that the interior lobes of the die are exactly opposite the flats of the polygonal punch. Below the upper lobed cavity of the die is a cylindrical cavity of smaller diameter and between the two is a conical surface which directs the metal of the lobes inwardly into the die cavity opposite the flats of the polygon. The preferred polygon is a hexagon.

3 Claims, 14 Drawing Figures

METHOD OF COLD FORMING

This is a division of application Ser. No. 864,544, filed Dec. 27, 1977 now U.S. Pat. No. 4,166,373 issued Sept. 4, 1979.

BACKGROUND OF THE INVENTION

The invention relates to cold extrusion of a metal part having a configuration consisting of a cylindrical exterior and a hollow polygonal interior.

1. Field of the Invention

The field of the invention is a new method of applying reverse extrusion by two or more successive extrusion steps whereby a mass of cold metal is first formed into an intermediate preparatory configuration. The preparatory blank is subsequently formed into the final desired configuration having walls of variable thickness circumferentially of the longitudinal axis of the final extruded product.

2. Description of the Prior Art

A method of forming a cup-shaped article having a smooth cylindrical interior surface and an outer polygonal exterior surface is shown by my U.S. Pat. No. 2,904,173 dated Sept. 15, 1959, in which the resulting exterior polygonal surface has its apices modified from a true polygon in order to improve the extrusion process by materially reducing the tendency for uneven flow during the cold extruding operation. In said patent, the original starting billet is converted into the final polygonal product by a single extrusion step and the efficiency of the process is enhanced by eliminating the sharp corners of the exterior polygonal shape. Conversely in the present invention, a method has been devised in which the final product retains the sharp contours of the polygon and improves the efficiency of the extrusion by the design of an intermediate with an unusual shape which in the second step compensates for the metal flow into the sharp corners of the interior polygonal surface. Thus in the manufacture of a part with cylindrical outside and polygonal inside, the new method uses the two step process hereinafter described with intermediate formation of a preparatory blank which is subsequently extruded by the second step.

In the conventional one step prior art method of forming a part with internal polygonal form, the method requires forcing a polygonal punch into the initial cold metal billet with the necessary force required to extrude the part. The force required is substantially higher than the new two step process because the load is in direct proportion to area of the tool and material to be extruded. As an example, using an hexagonally shaped punch, the load required to extrude the part would be the area of the punch multiplied by the unit loading required to extrude the material. Assume for example, that an hexagonally shaped punch is of such size as to have an area of one square inch and is used to cold extrude a metal billet which requires 150 tons per square inch of unit force. This would result in an extrusion force of 150 tons. Thereby, subjecting this hexagonal punch to a load of 150 tons. The new method of the present invention requires only a force of 48 tons, a reduction of 68%. In addition, the prior art one step process results in uneven ends which increases the difficulty in subsequent machining operations to produce the finished article.

SUMMARY OF THE INVENTION

The present invention differs from the known prior art. The invention relates to the manufacture of a part with a diametral exterior and a polygonal interior by the cold extrusion method. A typical industrial application of aforementioned product would be a wrench socket as used in conjunction with a comparable wrench for securing fasteners of a diversified type.

The new process requires a series of extrusion operations. First, a starting billet is extruded to form an intermediate preparatoy blank having a series of circumferentially arranged lobes on the exterior of the intermediate preparatory blank. The size of the lobes is determined by the ratio between the internal polygonal form of the finished part and the external diameter of the finished part as hereinafter more clearly explained. The number of the lobes on the preparatory blank is equal to the number of flats on the interior polygonal form of the finished product. In the first extrusion step, the starting billet is placed in the die cavity of the first extrusion apparatus and a punch is supported above the die in alignment therewith and lowered under pressure in the usual manner of cold extrusion. The die cavity corresponds to the exteriorly lobed surface of the preparatory blank while the punch is cylindrical corresponding to the interior surface of the preparatory blank. Upon completion of this first extrusion step, the intermediate blank is transferred into a second extrusion apparatus which includes a cylindrical die cavity corresponding to the cylindrical exterior of the final product and a punch of polygonal exterior form corresponding to the polygonal interior of the final product.

The objectives of the invention and the advantageous results obtained will be more fully set forth after describing a preferred embodiment.

DESCRIPTION OF A PREFERRED EMBODIMENT

Figure 1:
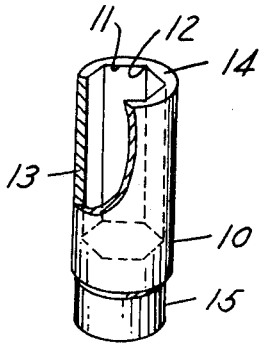
FIG. 1 is a perspective view of an article which can be made by the invention.
Figure 2:
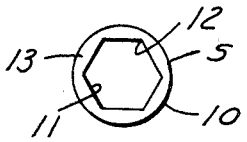
FIG. 2 is a top end view thereof.
Figure 3:
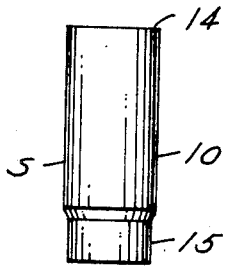
FIG. 3 is a side view thereof.

The object of the present invention is to produce by extrusion a cylindrical article having a hollow interior of polygonal contour. An example of such an article having walls of varying thickness in a circumferential direction is illustrated in FIGS. 1 to 3, which specifically is a spark plug socket, S. The upper part of the article S has an outer cylindrical wall 10, and a series of flat interior surfaces 11 which as shown are six in number forming a hexagon with apices at 12. The wall 13 extends lengthwise for a substantial distance from the open end 14 to a lower end portion 15 of slightly reduced outer size.

Figure 4:
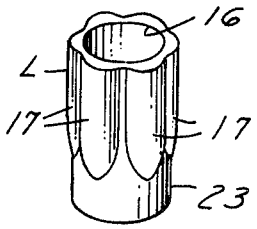
FIG. 4 is a perspective view of the lobed preparatory blank.
Figure 5:
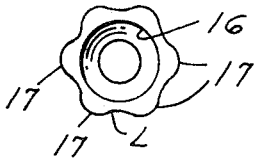
FIG. 5 is a top end view thereof.
Figure 6:
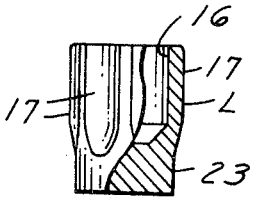
FIG. 6 is a longitudinal section thereof.
Figure 7:
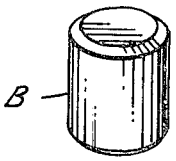
FIG. 7 is a perspective view of a starting billet.
Figure 8:
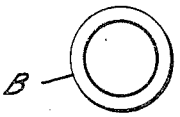
FIG. 8 is a top end view thereof.
Figure 9:
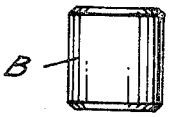
FIG. 9 is a side view thereof.

Such an article can be extruded from a billet B as shown in FIGS. 7, 8 and 9, which contains a predetermined mass of metal calculated to be equal to the mass of the final extruded article S. In accordance with this invention the extrusion is performed in two successive operations. After the first extrusion step there is formed from the billet B a lobed preparatory blank L shown in FIGS. 4, 5 and 6. The blank L has a cylindrical inner surface 16 and a series of outer lobes 17, the same in number as the number of apices 12 in the final article S.

Figure 10:
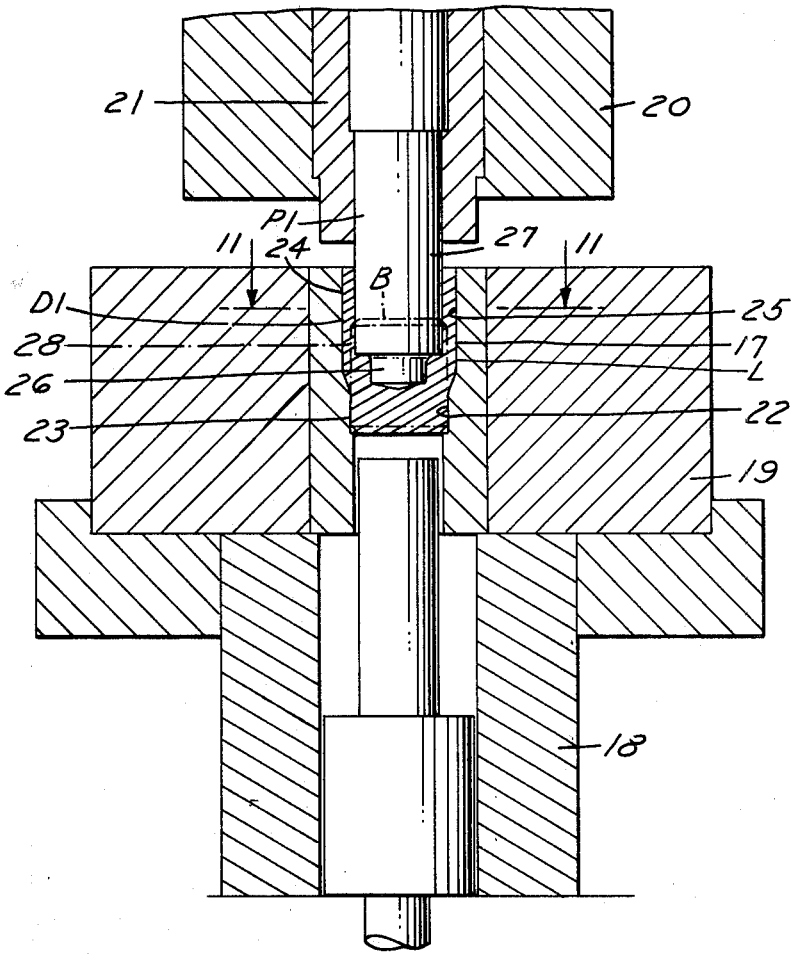
FIG. 10 is a vertical section through a machine for performing the first extension step.
Figure 11:
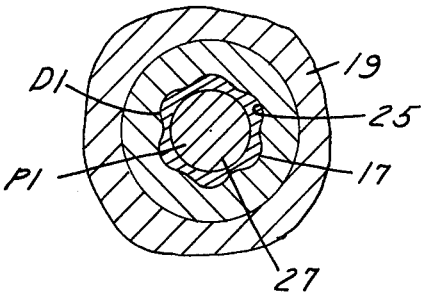
FIG. 11 is a cross-section on line 11—11 of FIG. 10.

The first extrusion step is carried out in the apparatus of FIG. 10 which is a conventional extruding machine provided, however, with a special die D1 and special punch P1. The machine itself has a base 18 which supports a stationary ring 19 within which is contained the die D1. A movable head 20 contains a sleeve 21 for receiving the punch P1.

Figure 12:
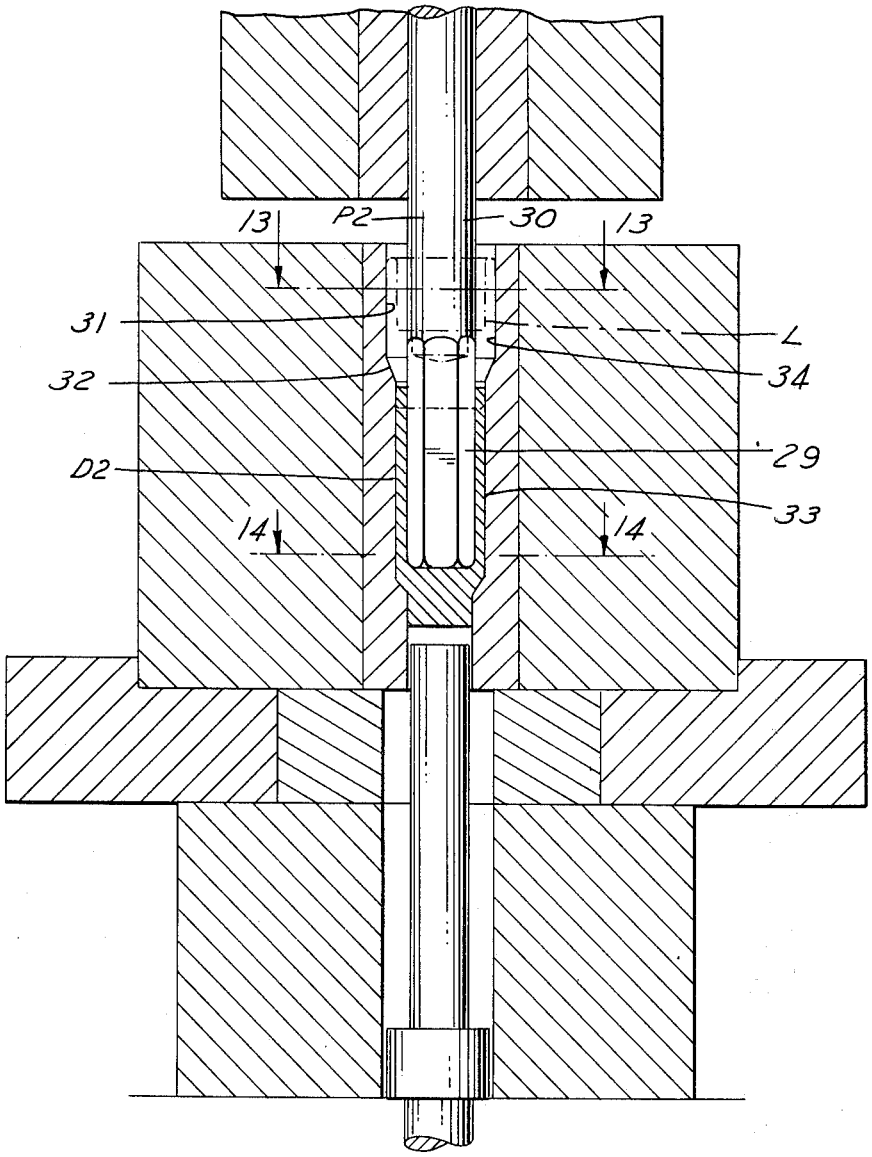
FIG. 12 is a vertical section through a machine for performing the second step.

The second extrusion step is carried out in the apparatus of FIG. 12 which is a conventional machine like the one in FIG. 10 except that it is provided with the special die D2 and the special punch P2.

PROCESS FOR PREPARING THE INITIAL BILLET

The billet B may be prepared by conventional methods either by sawing a round bar of a predetermined diameter proportional to the outside diameter 10 of the finished part S or by a cold heading machine. The billet diameter should be sized about ten percent (10%) smaller than the diameter 10 to allow it to be placed in the die cavity with a minimum amount of clearance. The billet also contains the same mass of metal as the desired mass of the final extruded part.

PROCESS FOR EXTRUDING THE LOBED PREPARATOY BLANK

The billet B is placed in the die cavity of the first die D1 in the machine of FIG. 10 where it is shown in dotted lines. The lower portion 22 of the die D1 is of the same size as the lower portion 23 of the preparatory blank L, while the upper portion 24 of the die has a configuration 25 corresponding to the desired external contours of the lobes 17. The punch P1 is of circular cross-section, the entrance end 26 being somewhat smaller than the main cylindrical wall 27 thereof, there being a billet 28 between these parts. p As the punch P1 descends under pressure into the die cavity the punch causes the metal to flow by reverse extrusion upwardly around the walls of the punch to fill the die cavity around the punch and form the extrusion into the shape illustrated in FIGS. 4–6 as the lobed preparatoy blank L.

At the completion of the downward stroke of punch P1 it is then withdrawn upwardly and the extruded preparatory blank is ejected from the machine in the usual manner. The blank L, as formed, is then subjected to the second extrusion step in the machine of FIG. 12 but before doing so is suitably heat-treated to anneal the metal.

PROCESS FOR EXTRUDING FINAL ARTICLE FROM THE LOBED PREPARATOY BLANK

Figure 13:
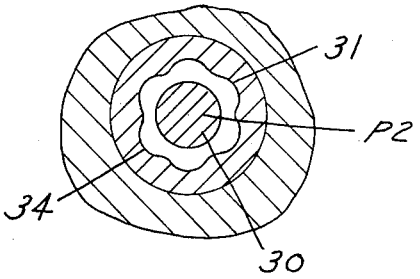
FIG. 13 is a cross-section on line 13—13 of FIG. 12.
Figure 14:
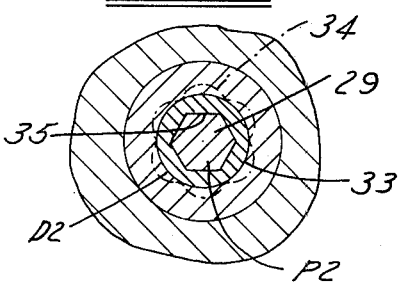
FIG. 14 is a cross-section on line 14—14 of FIG. 12.

The lobed preparatory blank L is placed in the die cavity of the second die D2 in the machine of FIG. 12. The punch P2 has the hexagonal exterior contour 29 at its lower portion as shown in FIG. 14 while the upper portion 30 is cylindrical as shown in FIG. 13.

The lobed preparatoy blank L is placed in the uppermost area 31 of the die cavity of die D2, which cavity 31 has a cross-sectional contour corresponding to the exterior of lobed blank L so as to accept said blank. Below said cavity 31 is the inwardly coned surface 32 which merges into the lower cylindrical surface 33 of the die D2, which is the same diameter as the final extruded article. The lobed cavity 31 is oriented in relation to the hexagonal surface 29 of punch P2 so that each lobe cavity 34 is directly opposite a flat 35 on punch P2.

Having now obtained proper placement of the lobed blank L in the upper die cavity 31, the punch P2 starts moving downward and enters the interior of the lobed blank L until it strikes the bottom surface. Continuing its downward movement the punch forces the blank into the lower die cavity so that the metal in lobes 17 is displaced inwardly into the spaces around the flats of the punch. At the same time the metal flows vertically upward around the hexagonal punch thereby creating the desired hexagonal interior form of the finished part S. The round exterior surface develops as the punch in its downward movement forces the lobes 17 beyond the coned surface 32 in the die cavity. The major diameter of the lobes being larger than the die diameter of the lower cylindrical surface 33, interference is created between the lobes and the die at that point which forces the metal in the blank to move laterally with respect to the vertical punch movement. This lateral movement of the metal causes it to completely fill the cavity around the hexagonal punch form, thereby creating the desired hexagonal interior form of the final article S. The small cross-sectional area of the cavity in die D2 compared with the cross-sectional area of the blank L gives a backward or reverse extrusion effect in this second extrusion step so that the length of the lobed blank L is increased substantially as will be evident from a comparison of FIGS. 1 and 3 on the one hand to FIGS. 4 and 6. After the completion of the downward stroke of punch P2, it is then withdrawn upwardly and the completed final extruded part S is ejected from the machine in the usual manner.

ADVANTAGES OF THE INVENTION

As will be seen from the above description, a part having an interior hexagonal shape and a round exterior shape is formed by a two step extrusion process. First an intermediate preparatory blank is formed in which the interior surface is cylindrical and in which the exterior has a series of outwardly protruding lobes. Then this intermediate is subjected to a second extrusion which more readily assumes the final desired configuration and with a lesser expenditure of energy than is possible when using a single extrusion step.

One advantage is that after the completion of the two step process the end of the extrusions remain even requiring not more than a minimum machining operation.

I claim:

1. An extrusion machine for producing a part having a cylindrical outer surface and a polygonal inner surface comprising a die having an upper cavity shaped to accept an exteriorly lobed blank, having a lower cavity of smaller diameter than the lobe diameter of said blank, a conical die surface between said upper and lower cavities, a punch having a polygonal outer surface and means for moving said polygonal punch into contact with said lobed blank which is in said upper cavity and continuing its movement together with said blank into the lower cavity of said die thereby moving the metal from said lobes inwardly while causing reverse extrusion upwardly until all of the metal from said blank fills the cavities between said punch and die.

2. An extrusion machine according to claim 1 in which the polygonal punch is hexagonal and the upper cavity is shaped to accept a blank having six circumferentially spaced outwardly extending lobes.

3. An extrusion machine according to claim 1 in which the polygonal punch is oriented about its longitudinal axis so that the flats of the polygon are opposite the internal lobes of the upper of said dies.

* * * * *